United States Patent [19]

Porat et al.

[11] Patent Number: 4,500,873

[45] Date of Patent: Feb. 19, 1985

[54] TESTING DEVICE FOR AN INTRUSION DETECTION SYSTEM

[75] Inventors: Chaim Porat; Yaacov Sadeh, both of Beer-Sheva, Israel

[73] Assignee: Beta Engineering & Development Ltd., Beer Sheva, Israel

[21] Appl. No.: 418,455

[22] Filed: Sep. 15, 1982

[30] Foreign Application Priority Data

Feb. 3, 1982 [IL] Israel ..... 64923

[51] Int. Cl.[3] ..... G08B 29/00

[52] U.S. Cl. ..... 340/515; 340/668

[58] Field of Search ..... 340/515, 541, 668

[56] References Cited

U.S. PATENT DOCUMENTS

| | | | |
|---|---|---|---|
| 2,615,970 | 10/1952 | Bagno | 340/515 |
| 2,798,214 | 7/1957 | Rowell | 340/515 X |
| 3,562,730 | 2/1971 | Hill et al. | 340/515 X |
| 3,781,858 | 12/1973 | Lewis | 340/515 |
| 4,367,459 | 1/1983 | Amir et al. | 340/541 |

*Primary Examiner*—James L. Rowland
*Assistant Examiner*—Brian R. Tumm
*Attorney, Agent, or Firm*—Benjamin J. Barish

[57] ABSTRACT

A taut wire intrusion detection system for a fence includes a testing device adapted to be actuated from a central station to apply a mechanical force to the fence wire in order to cause it to simulate an intrusion. The system further includes a testing circuit at the central station for actuating the testing device, and an indicator at the central station which receives the signal from the detector, and thereby indicates the actual response of the detector to the mechanical force.

10 Claims, 4 Drawing Figures

TESTING DEVICE FOR AN INTRUSION DETECTION SYSTEM

BACKGROUND OF THE INVENTION

The present invention relates to a testing device for an intrusion detection system for detecting intrusion attempts into a protected area. The invention is particularly useful when embodied in a security fence enclosing the protected area, and it is therefore described below with respect to such an application.

The known security fence types of intrusion detection systems usually include a plurality of electrical detectors at various locations on the fence, which detectors are connected to trip wires effective, when sensing an external force resulting from an attempted intrusion (e.g., cutting or pushing a sensor wire), or other disturbance on the wire, to output electrical signals in response to the sensed disturbance. The electrical signals from the variously-located detectors are transmitted to a central station which processes them and determines whether or not the signals received indicate an attempted intrusion and the location thereof. One of the drawbacks of the known systems, however, is that they generally do not include means for conveniently and quickly checking the overall system, including all the detectors and their connections to the central station, to assure that all the elements are in proper working order.

An object of the present invention is to provide a testing device for an intrusion detection system particularly useful in a security fence, and having advantages in the above respect.

SUMMARY OF THE INVENTION

According to a broad aspect of the present invention, there is provided an intrusion detection system including at least one sensor wire coupled to a detector for detecting an attempted intrusion by producing an electrical signal when sensing an external force applied to the sensor wire, characterised in that said security fence further includes a testing device adapted to be actuated from a central station to apply a mechanical force to said sensor wire in order to cause same to simulate an intrusion; and a testing circuit including means at said central station for actuating said testing device, and an indicator at said central station connected to receive the signal from said detector and thereby to indicate the actual response of said detector to said mechanical force.

A preferred embodiment of the invention is described below, wherein the testing device includes a solenoid having an electrical coil and an armature movable when the coil is energized to apply said mechanical force to the sensor wire. More particularly, in the described preferred embodiment, the arm is secured to the sensor wire in alignment with the armature so as to be engaged thereby when the coil is energized. The arm is secured in cantilever fashion from one end to said sensor wire, the opposite end of the arm being free and aligned with said armature.

Also, in the described preferred embodiment, the security fence includes a plurality of said detectors and a plurality of testing devices for testing them, said testing circuit including indicator means at said central station connected to receive the output signals from all the detectors to indicate their actual responses to the external forces applied by their respective testing devices. The testing circuit further includes sequencing means for actuating said testing devices in sequence.

An intrusion detection system constructed in accordance with the foregoing features provides a number of important advantages over the previously-known systems. Thus, the present invention permits each detector to be tested, separately and in a convenient manner, from the central station at a remote location, the results of the test also being viewable at the central station. In addition, not only are the detectors themselves tested in this manner, but also tested are all the elements from the sensor wires actuating the detectors to the central station. For example, if in a "taut wire" intrusion detection system the tension on a sensor wire is insufficient for the proper operation of the system, this will also be revealed upon actuation of the testing circuit.

BRIEF DESCRIPTION OF THE DRAWINGS

Further features and advantages of the invention will be apparent from the description below.

The invention is herein described, by way of example only, with reference to the accompanying drawings, wherein.

DESCRIPTION OF A PREFERRED EMBODIMENT

Figure 1:
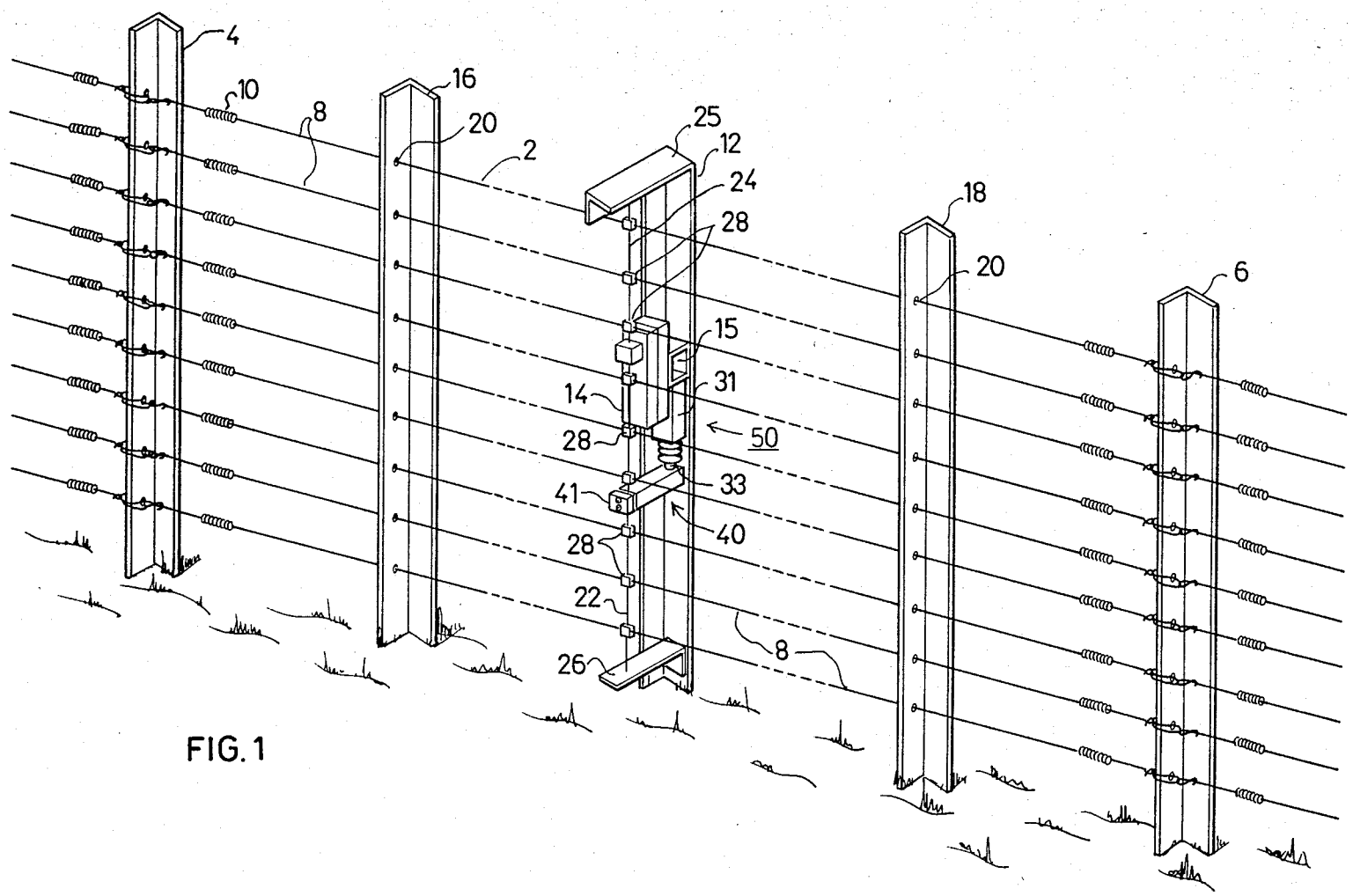
FIG. 1 is a three-dimensional view illustrating a section of one form of security fence including an intrusion detection system constructed in accordance with the invention.

The intrusion detection system is illustrated in the drawings as embodied in a security fence, generally designated 2, of the type described in U.S. Pat. No. 4,367,459. A section of this fence is illustrated in FIG. 1, wherein it will be seen that it includes three types of fence posts, namely: wire-supporting posts 4, 6 between which a group of wires 8 are secured under tension, e.g. by the use of springs 10; a detector-carrier pole 12 to which an intrusion detector 14 is secured by a bracket 15; and a pair of guiding poles 16, 18 located between the wire-supporting poles 4, 6 and each detector-carrier pole 12. The guiding poles 16, 18, shown for purposes of example as being of the right-angle profile type, are formed with openings 20 for loosely receiving the wires 8 in order to support them in substantially parallel, vertically-spaced relationship, while still permitting them to be freely moved longitudinally to actuate the detector 14 when any wire is cut, pushed or pulled during an attempted intrusion. The illustrated arrangement uses a single common detector 14 fixed by bracket 15 to an intermediate point on pole 12 and connected to a plurality of the wires 8. For this purpose, two vertically-extending wires 22, 24 are secured at their inner ends to the detector 14, and at their outer ends to a pair of brackets 25, 26 carried at the opposite ends of the detector-carrier pole 12. The horizontally-extending wires 8 are secured to wires 22, 24 at connection points 28.

Figure 2:
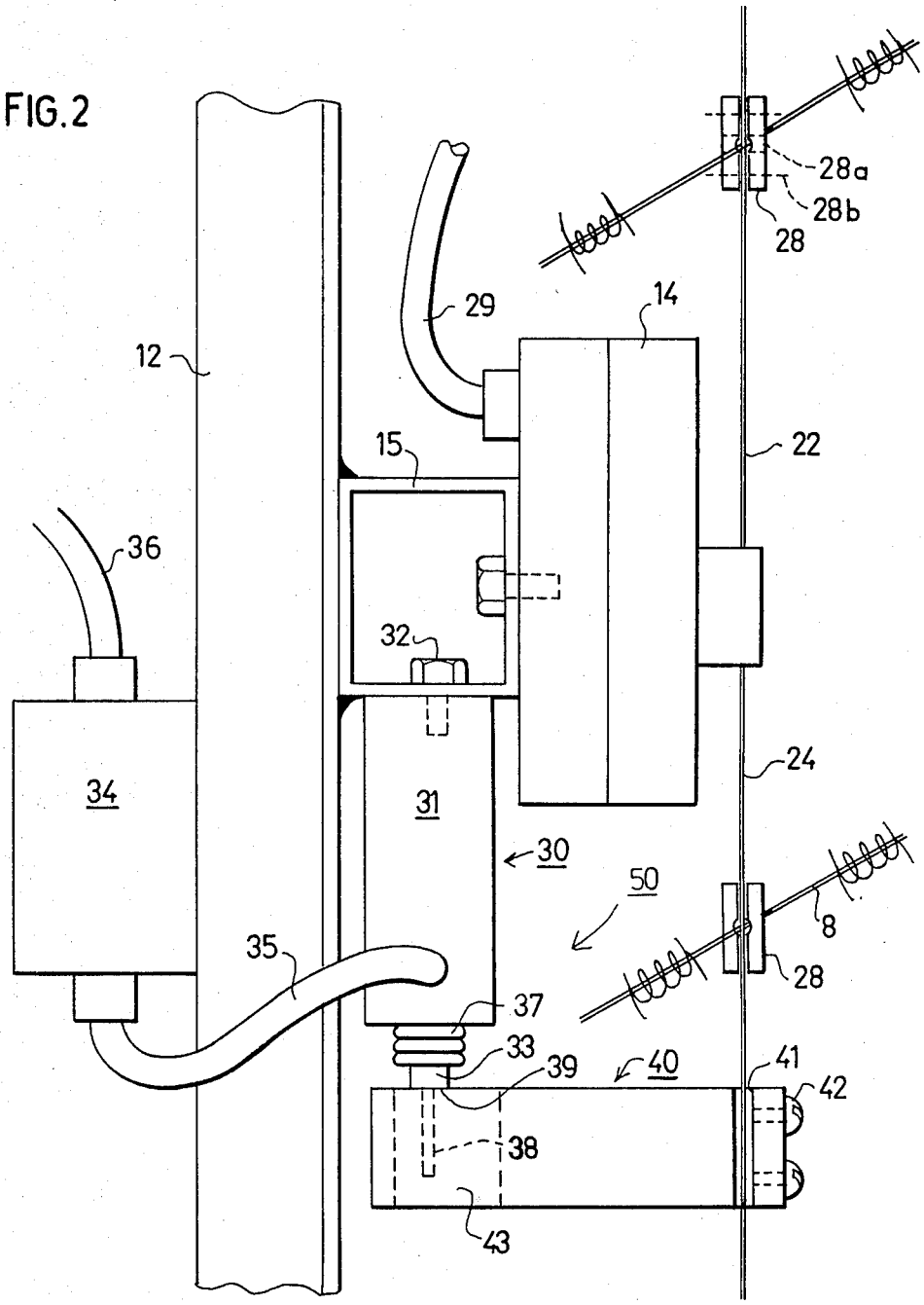
FIG. 2 is an enlarged fragmentary view illustrating the detector and testing device in the security fence of FIG. 1.

As shown in FIG. 2, each connection point 28 between the horizontal wires 8 and the vertically-extending wires 22, 24, is made by a pair of discs formed with a central aperture 28*a* aligned with the intersection of the respective pair of wires, the discs being secured together by fasteners 28*b* to cause the two wires to be firmly pressed against each other to thereby make a good mechanical connection between them.

The horizontally-extending wires 8 and the vertically-extending wires 22, 24 are all maintained in tension and serve as sensor wires, or trip wires, for sensing any attempted intrusion. Thus, if an intrusion is attempted by severing any of the horizontally-extending wires 8, or by pushing one or more to the side, the change in tension resulting from the attempt is transmitted to one of the vertically-extending wires 22, 24 by virtue of their connections 28 to the horizontally-extending wires 8, and from the latter wires to the detector 14. The detector 14 may be of the strain-gauge type producing an electrical signal in response to change in force (i.e., tension), which electrical signal is transmitted, via cable 29, to the central station remote location where it indicates the attempted intrusion by energizing an indicator, actuating an alarm, and/or recording this fact in a recorder.

The intrusion detection system illustrated in FIG. 1 of the drawings, insofar as described above, is more particularly described in U.S. Pat. No. 4,367,459, and therefore further details of its construction and operation are not deemed necessary herein.

According to the present invention, there is provided, for each detector 14, a testing device adapted to be actuated from the remotely-located central station so as to apply a mechanical force to one of the sensor wires, in this case the lower vertically-extending wire 24, connected to the detector in order to cause that sensor wire to simulate an intrusion. The illustrated system further includes a testing circuit including, at the remotely-located central station, means for sequentially actuating the testing devices, and an indicator for each of the testing devices to receive the signal from its respective detector and thereby to indicate the actual response of that detector to the so-applied mechanical force.

The testing device is more particularly illustrated in FIG. 2. It is constituted of two main elements, namely, a solenoid, generally designated 30, secured to the same bracket 15 to which the detector 14 is secured; and an arm, generally designated 40, secured to the lower, vertically-extending sensor wire 24.

Solenoid 30 includes an electrical coil housing 31 fixed to bracket 15 by a bolt 32, and an armature 33 movable within the coil when the coil is energized. The energization of the coil is controlled by a power supply unit 34 also fixed to pole 12, but preferably on the opposite side from detector 14 and solenoid 30, and is connected to the latter solenoid by an electrical conductor 35. The power supply 34 is in turn connected to the remotely-located central station by another conductor 36.

Armature 33, sealed within the coil housing 31 by a bellows 37, is retained in a retracted position within this housing by means of a spring, and is projected outwardly of the housing whenever the coil is energized. This armature is of cylindrical configuration, but its tip is of reduced cross-section, as shown at 38, thereby defining an annular shoulder 39 bordering its reduced-diameter tip.

Arm 40 is secured in cantilever fashion to sensor wire 24 so as to be in alignment with armature 33 of the solenoid 30. As shown particularly in FIG. 3, arm 40 is provided, at one end, with a slot 41 extending the complete height of the arm, but not its complete width, for receiving the sensor wire 24, and with fasteners 42 passing through the end face of the arm, for securing the arm to the sensor wire.

Figure 3:
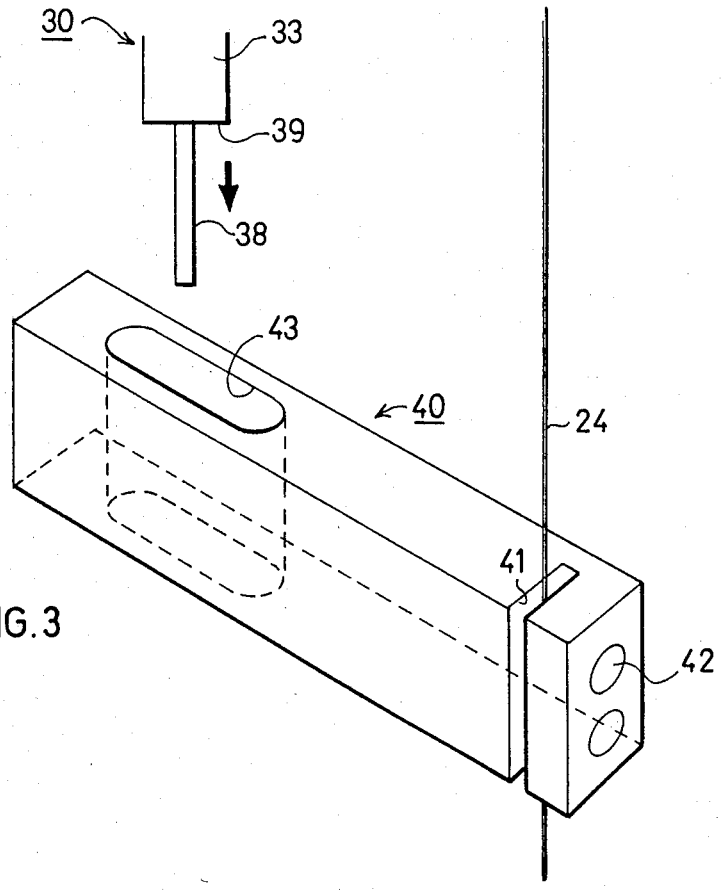
FIG. 3 is an enlarged perspective view illustrating the construction of the arm in the testing device of FIGS. 1 and 2.

The opposite end of arm 40 is formed with an elongated opening 43 for receiving the reduced-diameter tip 38 of the solenoid armature 33. As shown in FIG. 3, the width of opening 43 is larger than that of the armature tip 38, but less than that of the armature shoulder 39.

Arm 40 is applied to the sensor wire 24 by pressing the wire into slot 41. The arm is then moved longitudinally along the wire and also pivoted about the wire so that its elongated opening 43 receives the reduced-diameter tip 38 of the armature 33, with a slight distance between the upper face of the arm and the annular shoulder 39. When the arm is located in this position, its fasteners 42 are tightened to fix the arm to the sensor wire 24.

The arrangement is preferably such that no contact is made between the arm 40 and the armature 33 in the unenergized condition of the solenoid 30; however, whenever solenoid 30 is energized, its armature 33 is projected outwardly (downwardly in FIGS. 1–3) such that its shoulder 39 impacts against the upper face of arm 40 and thereby applies a force, via arm 40, to the sensor wire 24.

Sensor wire 24, as well as the other vertically-extending sensor wire 22, is secured to the sensing element 50 of the detector 14. Thus, when solenoid 30 is energized, the force applied by armature 33 against arm 40 is transmitted via sensor wire 24 to the detector 14.

Figure 4:
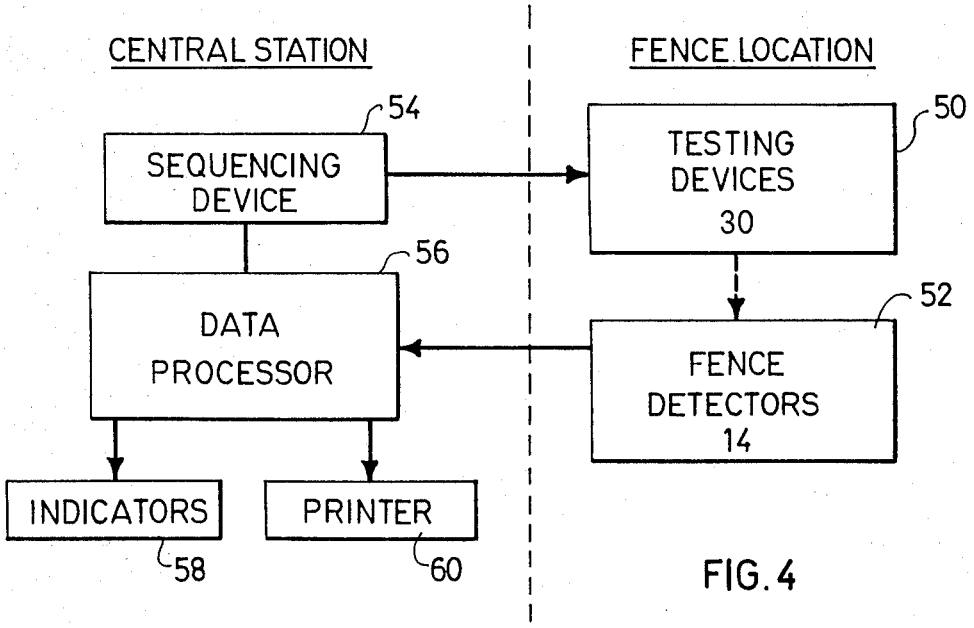
FIG. 4 is a block diagram illustrating the overall intrusion detection system of FIG. 1, particularly showing those portions at the fence location and those portions at the remotely-located central station.

FIG. 4 illustrates the overall system, particularly indicating those portions of the system at the fence locations and those portions at the remotely-located central station.

Thus, the fence location includes, as indicated by box 50, a plurality of the testing devices, each including a solenoid 30 and an arm 40 applied to the fence in the manner described above adjacent to each of the fence detectors 14, the detectors being generally designated by box 52 in FIG. 4.

The central station includes a sequencing device, generally designated 54, connected via the previously-mentioned conductor 36 to the solenoids 30 so as to actuate them in sequence. As the coil of each solenoid 30 is energized, in sequence, it causes its armature 33 to impact against the upper face of the aligned cantilever arm 40, thereby applying a force to the sensor wire 24 to which the arm is secured which force is transmitted to detector 14, as described above. Thus, the detectors 14 are sequentially actuated to output electrical signals in response to the force applied to their respective sensor wires 24. These electrical signals are fed, via output conductor 29 from the detectors, to a data processor unit 56 at the central station, where the electrical signals from the detectors are processed and outputted to various output devices, such as to indicators 58 indicating whether the respective detectors are operating properly, and to printer 60 recording the results of the testing operation as well as the normal operation of the system.

It will thus be seen that the operator, at the remotely-located central station, may conveniently test the overall operation of the system by merely actuating the sequencing device 54 of the testing circuit, and observing the results on the indicators 58 and/or printer 60. The illustrated system not only tests whether or not the individual detectors 14 are operating properly, but also tests whether all the elements from the cantilever arms 40 secured to their sensor wires 24 to the data processor 56 are operating properly, and the outputs thereof. For example, if a vertically-extending sensor wire 24, to which a cantilever arm 40 of the testing device is secured, is not sufficiently taut for the proper operation of the system, this fact will also be indicated during the testing operation.

Instead of applying the testing force, simulating an intrusion, to one of the vertically-extending sensor wires 24, it will be appreciated that it could also be applied to one of the horizontally-extending wires 8, by merely mounting the cantilever arm 40 to such a wire, and also mounting the solenoid 30 in position so that its armature impacts against that arm.

Many other variations, modifications and applications of the invention will be apparent.

What is claimed is:

1. An intrusion detection system including at least one sensor wire coupled to a detector for detecting an attempted intrusion by producing an electrical signal when sensing an external force applied to the sensor wire, characterized in that said system further includes:

a testing device adapted to be actuated from a central station to apply a mechanical force to said sensor wire in order to cause same to simulate an intrusion;

and a testing circuit including means at said central station for actuating said testing device, and an indicator at said central station connected to receive the signal from said detector and thereby to indicate the actual response of said detector to said mechanical force.

2. A system according to claim 1, wherein said testing device includes a solenoid having an electrical coil and an armature movable when the coil is energized to apply said mechanical force to the sensor wire.

3. The system according to claim 2, wherein said testing device further includes an arm secured to said sensor wire in alignment with said armature so as to be engaged thereby when the coil is energized.

4. The system according to claim 3, wherein said arm is secured in cantilever fashion from one end to said sensor wire, the opposite end of the arm being free and aligned with said armature.

5. The system according to claim 4, wherein said armature is formed with a tip of reduced cross-section and bordered by a shoulder, said free end of the arm being formed with an aperture of dimensions sufficiently large so as to freely receive said tip therein, but not said enlarged shoulder of the armature, the armature shoulder thereby impacting the apertured face of the arm when said electrical coil is energized.

6. The system according to claim 5, wherein said one end of the arm also is formed with an aperture for receiving said sensor wire to which the arm is secured, said arm further including fasteners for securing same at the desired location on said sensor wire in alignment with said armature.

7. The system according to claim 1, wherein said testing device and said detector are mounted to the same fencepost.

8. The system according to claim 1, wherein said system further includes a plurality of said detectors and a plurality of testing devices for testing said detectors, said testing circuit including said indicator at said central station connected to receive the output signals from all the detectors to indicate their actual responses to the external forces applied by their respective testing devices.

9. The system according to claim 8, wherein said testing circuit further includes sequencing means for actuating said testing devices in sequence.

10. A security fence including an intrusion detection system according to claim 1.

* * * * *